United States Patent [19]

Nieuwendijk et al.

[11] Patent Number: 4,829,581

[45] Date of Patent: May 9, 1989

[54] ELECTRODYNAMIC TRANSDUCER COMPRISING A TWO-PART DIAPHRAGM

[75] Inventors: Joris A. M. Nieuwendijk; Georgius B. J. Sanders, both of Eindhoven, Netherlands

[73] Assignee: U.S. Philips Corp., New York, N.Y.

[21] Appl. No.: 872,057

[22] Filed: Jun. 6, 1986

[30] Foreign Application Priority Data

Jun. 7, 1985 [NL] Netherlands ..... 8501650

[51] Int. Cl.[4] ..... H04R 7/18; H04R 1/24; H04R 7/04; H04R 7/18

[52] U.S. Cl. ..... 381/193; 381/153; 381/158; 381/159; 381/184; 381/186; 381/174; 381/202; 381/204

[58] Field of Search ..... 381/193, 182, 153, 184, 381/158, 185, 159, 186, 192, 202, 203; 181/164, 165, 174

[56] References Cited

U.S. PATENT DOCUMENTS

| | | | |
|---|---|---|---|
| 1,459,803 | 6/1923 | Steurer | 381/202 |
| 2,146,975 | 2/1939 | Nagelvoort | 181/165 |
| 3,046,362 | 7/1962 | White | 181/165 |
| 3,573,396 | 4/1971 | Schoengold | 181/202 |
| 4,315,112 | 2/1982 | Hofer | 181/186 |
| 4,321,434 | 3/1982 | Irie | 381/193 |

FOREIGN PATENT DOCUMENTS

| | | |
|---|---|---|
| 3123098 | 1/1983 | Fed. Rep. of Germany . |

OTHER PUBLICATIONS

Tremaine, Howard, *Audio Cyclopedia,* 1969, Sections 20.29, 20.45 and 20.60.

*Primary Examiner*—Jin F. Ng
*Assistant Examiner*—Danita R. Byrd
*Attorney, Agent, or Firm*—Bernard Franzblau

[57] ABSTRACT

An electrodynamic transducer (1) comprises a diaphragm with a central part (2) and a peripheral part (3) and a voice-coil device (9, 10) coupled to the central part (2). The diaphragm (2, 3) cooperates with an enclosed volume (6), the enclosed volume being such that $$\frac{f_o}{f_o'} \geqq 0.75 \frac{S_2}{S_1}$$

where $f_o$ and $f_o'$ are the anti-resonance frequencies of a transducer respectively with or without the enclosed volume behind the diaphragm. These frequencies each correspond to a local minimum situated between two maxima ($f_1$ and $f_1'$ respectively, and $f_2$ and $f_2'$ respectively) in the input impedance curves $Z_1$ in the case of a transducer with the enclosed volume and in the case of a transducer without the enclosed volume. The maxima correspond to the two resonance frequencies for which the central part of the peripheral part move in phase and in phase opposition relative to one another, and $S_1$ and $S_2$ are the surface areas of the central part and the peripheral part, respectively, where $S_2/S_1 \geqq 2$.

19 Claims, 4 Drawing Sheets

ELECTRODYNAMIC TRANSDUCER COMPRISING A TWO-PART DIAPHRAGM

BACKGROUND OF THE INVENTION

This invention relates to an electrodynamic transducer comprising a diaphragm, a magnet system and a voice-coil device which is coupled to the diaphragm and which is situated in an air gap formed by the magnet system. The diaphragm comprises a central part and a surrounding peripheral part, the surface area of the peripheral part being larger than that of the central part, the central part having a higher stiffness than the peripheral part and the voice-coil device being coupled to the central part. Such a transducer is disclosed in German Patent Specification DE No. 3,123,098. A characteristic feature of the peripheral part of the diaphragm in this known transducer is that it exhibits practically no mechanical pretension, so that the vibration behaviour of this peripheral part is mainly determined by the resistance to bending and the visco-elastic and damping properties of the material of which this peripheral part is made.

SUMMARY OF THE INVENTION

The known transducer has the disadvantage that the acoustic signal produced by the transducer contains a substantial distortion component. It is an object of the invention to provide a transducer with a substantially lower distortion. To this end the electrodynamic transducer in accordance with the invention is characterized in that the peripheral part has at least substantially no resistance to bending in a direction perpendicular to its inner circumference, in that the diaphragm cooperates with an at least substantially enclosed volume, the enclosed volume being selected in such a way that $$\frac{f_o}{f_o'} \geqq 0.75 \frac{S_2}{S_1},$$

where $S_1$ and $S_2$ are the surface areas of the central part and the peripheral part respectively, $f_o$ is the anti-resonance frequency, i.e. that frequency in the frequency characteristic of the input impedance of the transducer which corresponds to a local minimum situated between two maxima in said characteristic which correspond to those two resonance frequencies for which the central part and the peripheral part vibrate in phase and in phase oposition with one another, and $f_o'$ is said anti-resonance frequency for the transducer without the enclosed volume and incorporated in a baffle, and further that $$S_2/S_1 \geqq 2.$$

Preferably, the peripheral part is mechanically pretensioned, or the peripheral part is provided with corrugations which extend substantially parallel to the inner and outer circumference of the peripheral part.

The invention is based on the recognition that the high distortion in the known transducer is caused by a poor dynamic centering of the voice coil in the air gap of the magnet system. This poor centering results from the fact that the peripheral part is (practically) not mechanically pretensioned. Moreover, the frequency characteristic of the known transducer exhibits a number of undesired peaks and dips which also give rise to a high distortion.

When, in accordance with the invention, the peripheral part is mechanically pretensioned or provided with corrugations which extend parallel to the circumference, and in addition an enclosed volume is provided behind the diaphragm, the centering of the voice-coil (former) in the air gap is improved. Moreover, as the peripheral part has (substantially) no resistance to bending, the vibration behaviour of the transducer is now mainly determined by the mechanical pretension in the peripheral part (of course in conjunction with the mass of the diaphragm and the voice coil). If, in addition, the enclosed volume behind the diaphragm and the ratio $S_2/S_1$ are selected in such a way that the above formula is satisfied, it is achieved that relative to $f_o'$ the frequency $f_o$ is shifted so far towards higher frequencies that a large number of undesired peaks and dips will be situated at frequencies below the frequency $f_o$. Since the frequency $f_o$ substantially corresponds to the lower limit of the operating frequency range of the transducer, these peaks and dips are now situated outside the operating frequency range of the transducer in accordance with the invention, so that the distortion is also reduced drastically.

For a satisfactory effect $S_2/S_1$ should be selected to be larger than or equal to two. The frequency $f_o$ is then situated sufficiently far above $f_o'$. Suitably, the surface areas $S_1$ and $S_2$ are seleted so as to satisfy $$2.5 \leqq S_2/S_1 \leqq 15.$$

The upper limit for $S_2/S_1$ is necessary in order to insure a satisfactory centering of the voice-coil device in the air gap.

In accordance with the invention, a transducer can be realised in which the enclosed volume can be very shallow so that a very thin flat transducer is obtained.

With respect to the enclosed volume it is to be noted that, if necessary, a vent hole may be formed to compensate for variations in atmospheric pressure. For the dynamic behaviour of the transducer the volume may then still be regarded as an enclosed volume.

If, moreover, care is taken that the ratio $m_2/m_1$ is selected so as to satisfy $$\frac{\left[\frac{S_2}{S_1}\cdot\frac{f_o}{f_o'}\right]^2}{\left[\frac{f_o}{f_o'}\right]^2 + \frac{1}{2}\left[\frac{S_2}{S_1}\right]^2 - 1} \leqq \frac{m_2}{m_1} \leqq \frac{\left[2\cdot\frac{S_2}{S_1}\cdot\frac{f_o}{f_o'}\right]^2}{\left[\frac{f_o}{f_o'}\right]^2 + \frac{1}{2}\left[\frac{S_2}{S_1}\right]^2 - 1}$$

where $m_1$ is the mass of the central part and of the voice-coil device and $m_2$ is the mass of the peripheral part, a transducer is obtained in which the peripheral part behaves as a passive radiator at low frequencies (i.e. the low-frequency part of the frequency range of the transducer), so that the peripheral part provides a controlled contribution to the sound radiation, thereby yielding the advantages of a system comprising a passive radiator. The contribution of the peripheral part to the sound radiation decreases for higher frequencies so that ultimately only the central part effectively contributes to the sound radiation.

Peaks as a result of higher-order modes in the peripheral part can be suppressed effectively by selecting the mechanical damping of the peripheral part in such a way that the mechanical quality factor of the material of the peripheral part is sufficiently low. The degree of damping of the peripheral part is apparent from the number of peaks in the frequency characteristic of the electrical input impedance of the transducer. If this characteristic comprises two peaks corresponding to the resonances for which the central part and the peripheral part move in phase and in phase opposition relative to one another, the damping is correct. If the frequency characteristic exhibits more peaks, the damping is too low and, consequently, the quality factor too high. If the frequency characteristic has less than two peaks the damping is too high and the quality factory is consequently too low.

The desired degree of damping of the peripheral part can be obtained when the peripheral part comprises a layer of a damping material. For example, a class-2 ball-bearing grease may be deposited between two layers forming the peripheral part.

In order to satisfy the formula for $m_2/m_1$ it may sometimes be necessary to increase or reduce the mass $m_2$ of the peripheral part. This may be achieved by mixing the ball-bearing grease with a material having a higher or a lower density respectively. It is, for example, possible to add copper powder (in order to make the peripheral part heavier) are hollow glass particles or granules of a plastics foam (in order to reduce the weight of the peripheral part). It is also possible to increase or reduce the weight of the central part, as desired. Reducing the weight of the central part can be achieved, for example, by giving a portion of the central part situated within the voice coil or in line therewith a dome shape. A curved surface provides a higher stiffness than a non-curved surface. Therefore, the thickness of the dome-shaped portion may be reduced. As a result, the weight of the central part is reduced. Moreover, it is possible to vary the voice-coil diameters substantially by sealing the voice coils by means of a dome-shaped cap.

Another possibility is to couple the voice-coil device to the central part via an auxiliary cone. This also enables the weight of the central part to be reduced, namely in the case where the central part has a hole of the size of the outer circumference of the auxiliary cone and this auxiliary cone is coupled to the central part at its outer circumference along the circumference of the hole. In this case the auxiliary cone in fact also belongs to the central part. When, in embodiments in which the central part (partly or wholly) is dome-shaped or conical, the magnitude of the surface area $S_1$ of the central part is determined, allowance is to be made for the fact that $S_1$ denotes the magnitude of the surface area of the projection of the central part on a plane surface perpendicular to the axis of the voice-coil device. Obviously, the same applies to $S_2$ if the peripheral part is not flat.

BRIEF DESCRIPTION OF THE DRAWINGS

The invention will now be described in more detail, by way of example, with reference to the drawings in which identical parts bear the same reference numerals. In the drawings

DESCRIPTION OF THE PREFERRED EMBODIMENTS

Figure 1:
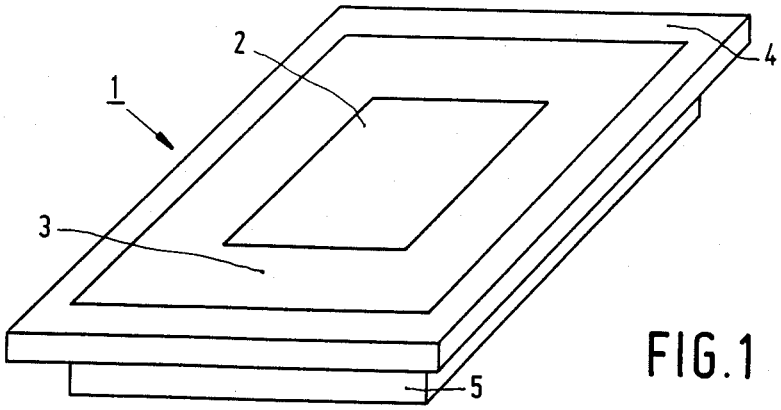
FIG. 1 is a perspective view of the transducer.
Figure 2A:
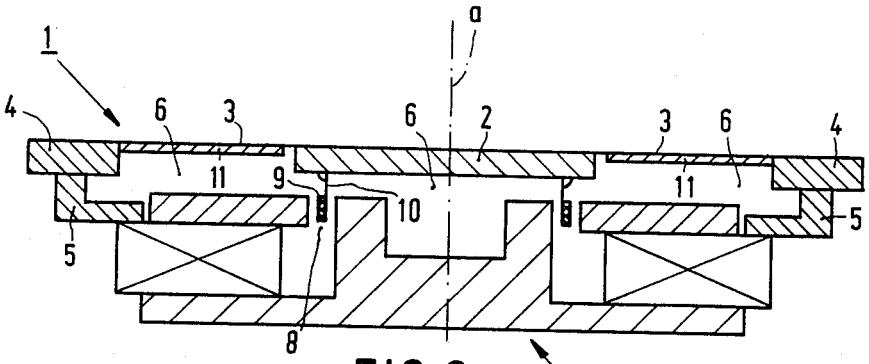
FIG. 2*a* is a sectional view of the transducer of FIG. 1.

FIG. 1 is a perspective view showing a transducer 1 comprising a diaphragm which comprises a central part 2 surrounded by a peripheral part 3. The diaphragm has a rectangular shape but may alternatively have a different shape, for example oval or circular. Along its outer circumference the diaphragm is secured to the chassis 4 of the transducer. The chassis 4, the diaphragm 2 and the rear element 5 bound an enclosed volume 6. This volume 6 is illustrated in FIG. 2*a* which is a vertical sectional view of the transducer of Fig. 1. The element 5 may be an enclosure in which the transducer is mounted or may comprise the magnet system 7 of the transducer 1 together with the part designated 5, which then forms part of the chassis. The said magnet system 7 is of a conventional construction and requires no further explanation. The voice coil 9 is arranged in the air gap 8 formed by the magnet system 7 and is coupled to the central part 2 via the voice-coil former 10.

The central part 2 has a higher stiffness than the peripheral part 3. The central part may be made of a hard plastics, for example a polymethacryl imide foam. The peripheral part 3 is mechanically pretensioned in the plane of the diaphragm and has substantially no resistance to bending. The peripheral part 3 may be made of, for example, a thin plastics foil, for example Kapton (Trade Name) and, if desired, it may be coated with a damping layer 11. However, this damping layer should not contribute to the resistance to bending of the peripheral part 3. The surface area $S_1$ of the central part 2 and the surface area $S_2$ of the peripheral part 3 comply with the following relationship $$S_2/S_1 \geqq 2 \quad (1)$$

but preferably $$2.5 \leqq S_2/S_1 \leqq 15 \quad (2)$$

Figure 3A:
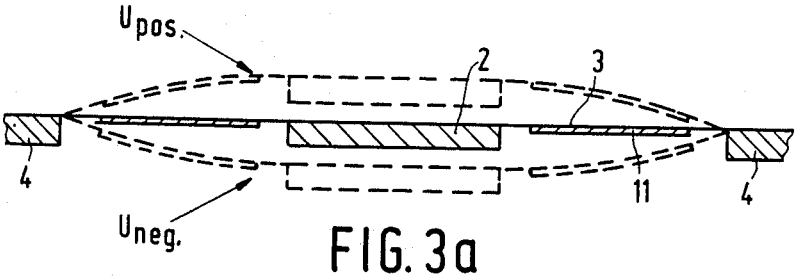
FIGS. 3*a* and 3*b* represent vibration modes of the diaphragm for which the central part and the peripheral part move in phase and in phase opposition, respectively, with respect to each other.
Figure 3B:
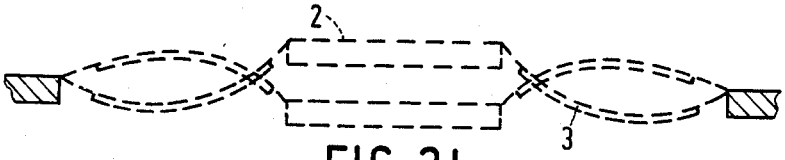
Figure 2B:
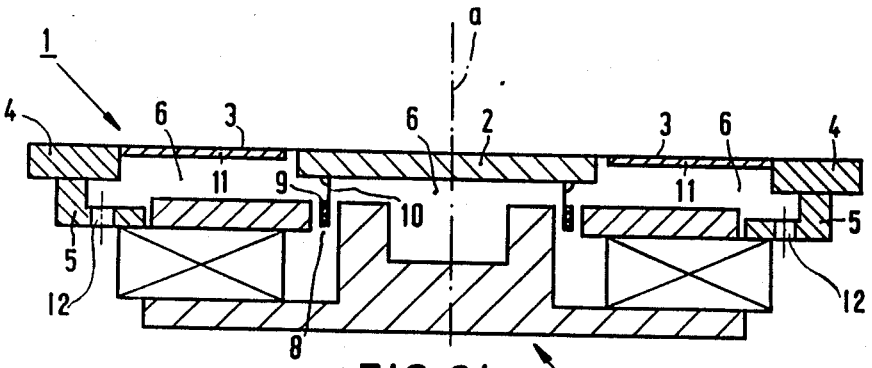
FIG. 2*b* shows for the purpose of explanation a sectional view of the transducer of FIG. 1, but without an enclosed volume behind the diaphragm.

Further, the enclosed volume 6 should be selected in such a way that the ratio $S_2/S_1$ and the ratio $f_o/f_o'$ satisfy the following relationship:

$$f_o/f_o' \geqq 0.75 \cdot S_2/S_1 \quad (3)$$

where $f_o$ is the anti-resonance frequency, being that frequency in the frequency characteristic of the electrical input impedance $Z_i$ of the transducer of FIGS. 1 and 2a which corresponds to the local minimum situated between those two maxima in this characteristic which correspond to the two resonant frequencies for which the central part and the peripheral part vibrate in phase and in anti-phase respectively. The two vibration modes corresponding to these resonance frequencies are represented in FIGS. 3a and 3b. FIG. 3a shows the vibration mode for which the central part 2 and the peripheral part 3 move in phase with one another. The broken lines $u_{pos}$ illustrate the maximum excursion of the diaphragm in one direction, the positive direction, and the broken lines $u_{neg}$ represent the maximum excursion of the diaphragm in the other or negative direction. It is evident from FIG. 3a that the central part 2 and the peripheral part 3 move in phase with one another. FIG. 3b illustrates the vibration mode in which the central part 2 and the peripheral part 3 move in phase opposition with each other. This can be seen in that, if the central part 2 has an excursion in the one or positive direction, the peripheral part 3 mainly deflects in the other or negative direction, and vice versa. A movement in phase opposition to each other means that the two parts of the diaphragm are 180° out of phase relative to each other. For example, for the anti-resonance frequency $f_o$ the two parts of the diaphragm are 90° out of phase with each other. In formula (3) $f_o'$ is also an anti-resonance frequency, which is defined in the same way as $f_o$ but now for the transducer of FIGS. 1 and 2b incorporated in a baffle and without the transducer having an enclosed volume behind the diaphragm 2, 3. The transducer of FIG. 2b does not have an enclosed volume because of the presence of holes 12 in the element 5.

The effect of the magnitude of the enclosed volume 6 on the behaviour of $f_o/f_o'$ will be explained with reference to FIGS. 4 and 5.

A further requirement imposed on the transducer in FIGS. 1 and 2a is that the ratio $m_2/m_1$ of the mass $m_1$ of the central part 2 plus the voice-coil device 9, 10 and the mass $m_2$ of the peripheral part 3 should satisfy the equation $$\frac{\left[\frac{S_2}{S_1}\cdot\frac{f_o}{f_o'}\right]^2}{\left[\frac{f_o}{f_o'}\right]^2+\frac{1}{2}\left[\frac{S_2}{S_1}\right]^2-1} \leqq \frac{m_2}{m_1} \leqq \frac{\left[2\cdot\frac{S_2}{S_1}\cdot\frac{f_o}{f_o'}\right]^2}{\left[\frac{f_o}{f_o'}\right]^2+\frac{1}{2}\left[\frac{S_2}{S_1}\right]^2-1} \quad (4)$$

The damping should also meet specific requirements. Preferably, the electrical damping should be selected in such a way that the electrical quality factor $Q_e$ at $f_o$ complies with $$0.5 \leqq Q_e \leqq 1 \quad (5)$$

where $Q_e$ can be derived from $$Q_e = \frac{m_1\, 2\pi f_o\, R_e}{B^2 1^2} \quad (6)$$

where $R_e$ is the d.c. resistance of the voice coil 9 and B1 is the B1 product of the magnet system 7.

Formula (5) represents a general requirement imposed on electro-acoustic transducers.

The mechanical damping of the peripheral part 3 should be selected in such a way that the frequency characteristic representing the frequency response versus the electrical input impedance $Z_i$ of the transducer of FIGS. 1, 2 in principle exhibits only two maxima which correspond to those two resonances for which the central part 2 and the peripheral part 3 move in phase and in phase opposition respectively, as explained with reference to FIG. 3. For this also see the frequency characteristic of FIG. 4b, which will be described hereinafter and has two maxima at the frequencies $f_1$ and $f_2$.

If the damping of the peripheral part 3 is too low the frequency characteristic will exhibit more resonance peaks corresponding to higher-order vibration modes of the peripheral part 3, which is undesirable because these higher-order vibration modes give rise to a certain degree of distortion. Excessive damping will result in a substantial loss of efficiency, which is equally undesirable. In the case of excessive damping the two peaks corresponding to said two principal modes for which the two parts of the diaphragm vibrate in phase and in phase-opposition will become very broad and it will no longer be possible to distinguish one peak or both peaks.

The desired damping can be obtained by means of the damping layer 11, for example a rubber layer. Another possibility is to arrange, either alternatively or in addition, a damping material, for example glass wool, in the enclosed volume 6 behind the diaphragm.

Figure 4A:
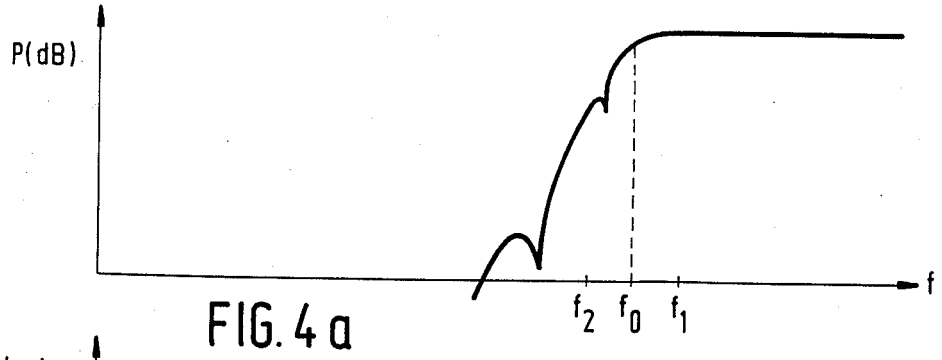
FIG. 4*a* shows a frequency characteristic of the sound pressure of the transducer of FIG. 1
Figure 4B:
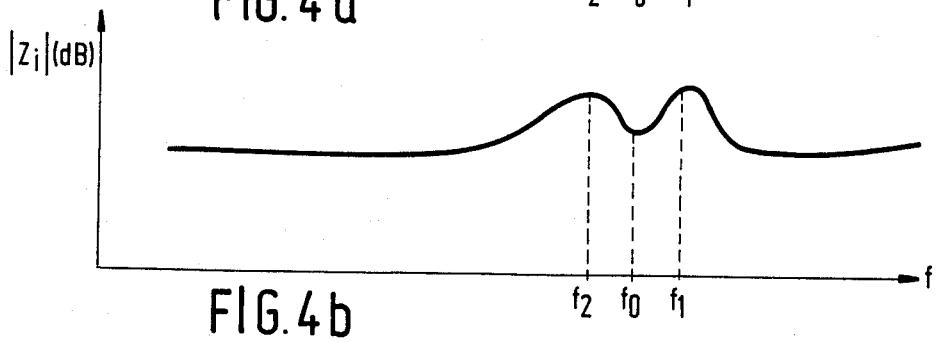
FIG. 4*b* shows a frequency characteristic of the input impedance of the transducer of FIG. 1, FIGS. 5*a* and 5*b* are characteristics representing the frequency response versus the sound pressure and the input impedance of the transducer of FIG. 1 respectively, without the enclosed volume behind the diaphragm and with the transducer incorporated in a baffle.
Figure 5A:
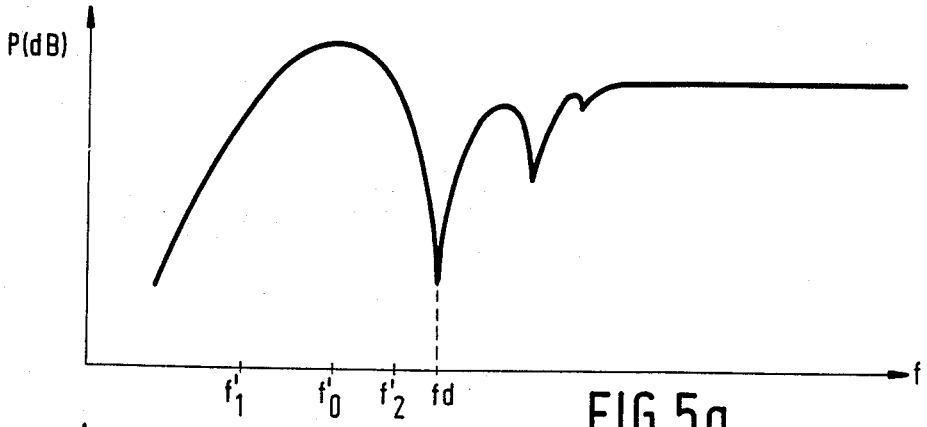
Figure 5B:
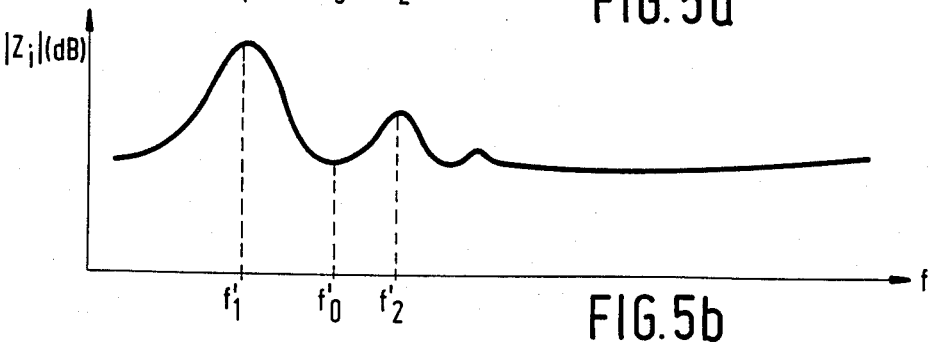

The behaviour of the transducer shown in FIGS. 1, 2a which satisfies formulas (2), (3), (4) and (5) will now be described in more detail with reference to FIG. 4. FIG. 4a illustrates the on-axis sound pressure P as a function of the frequency, the transducer being driven with a constant input voltage, and FIG. 4b represents the electrical input impedance of the transducer as a function of the frequency. FIGS. 5a and 5b respectively represent the sound pressure and the input impedance of the transducer of FIGS. 1, 2b not provided with an enclosed volume behind the diaphragm 2, 3 and incorporated in a baffle.

The impedance curve $Z_i$ in FIG. 5b exhibits a number of maxima corresponding to resonances of the diaphragm 2, 3. The frequency $f_1'$ corresponds to that resonance of the diaphragm for which the central part 2 and the peripheral part 3 vibrate in phase, see FIG. 3a, while $f_2'$ corresponds to a situation in which the central part 2 and the peripheral part 3 are out of phase, see FIG. 3b. Maxima at higher frequencies in the curve $Z_i$ of FIG. 5b correspond to higher-order vibration modes of the diaphragm, mainly vibration modes in the peripheral part 3. A minimum is situated between $f_1'$ and $f_2'$ at the anti-resonant frequency $f_o'$.

As a result of the vibration modes in the diaphragm the sound pressure curve of FIG. 5a exhibits an irregular shape. For example, the dip in the curve P at the frequency $f_d$ is caused by the resonance at $f_2'$. At this frequency $f_d$ the contributions of the central part and the peripheral part to the acoustic output signal of the transducer largely cancel one another because the two parts vibrate in phase opposition and provide equal (but opposite) acoustic contributions at this frequency. Therefore, it is not surprising that the dip in the curve of FIG. 5*a* at $f_d$ does not coincide with the peak at $f_2'$ in FIG. 5*b*. Peaks and dips as a result of higher-order modes are less pronounced because they can be or are damped more effectively.

In the embodiment shown in FIGS. 1, 2*a* the transducer comprises an enclosed volume 6 behind the diaphragm. Therefore, the resonant frequencies $f_1'$ and $f_2'$ in FIG. 5*b* are shifted towards higher frequencies. This is visible in FIG. 4*b*. Since the provision of the enclosed volume 6 has more influence on that resonance frequency for which the central part 2 and the peripheral part 3 vibrate in phase than on the resonant frequency for which the central part 2 and the peripheral part 3 vibrate in anti-phase, the frequency $f_1'$ in FIG. 5*b* will be shifted further to the right than the frequency $f_2'$.

If the enclosed volume is selected in such a way that the equations (3) and (4) are satisfied, the frequency $f_1'$ will be shifted so far to the right that this frequency (like $f_1$ in FIG. 4*b*) will be situated to the right of $f_2$, corresponding to the resonant frequency for which the central part 2 and the peripheral part 3 are out of phase relative to one another.

The enclosed volume 6 has even less influence on the higher-order resonant modes, i.e. the higher resonant frequencies, which are therefore hardly shifted (compare the dips in the characteristics of FIGS. 4*a* and 5*a*). As a result, the lower limit of the operating-frequency range is also shifted towards higher frequencies. This lower limit substantially corresponds to the frequency $f_o$. This is evident from FIG. 4*a* because the curve has a roll-off of roughly 18 dB/oct from this frequency towards lower frequencies, as is known from bass-reflex systems. In this way it is achieved that a number of undesired higher-order modes are situated outside the operating range of the transducer (to the left of $f_o$), which makes frequency characteristic (of FIG. 4*a*) much flatter so that there is less distortion. As already stated, the modes of even higher orders which are situated within the operating range of the transducer can readily be damped, for example by means of the damping material 11.

A comparison of the sound-pressure curves of FIGS. 4*a* and 5*a* shows that the transducer of FIGS. 1, 2*a* can reproduce less low frequencies. This may be regarded as a disadvantage. However, the transducer of FIG. 1 can be dimensioned in such a way that $f_o$ in FIG. 4 is situated at the desired lower limit of the transducer, so that the desired frequency range of the transducer can still be obtained.

Figure 6:
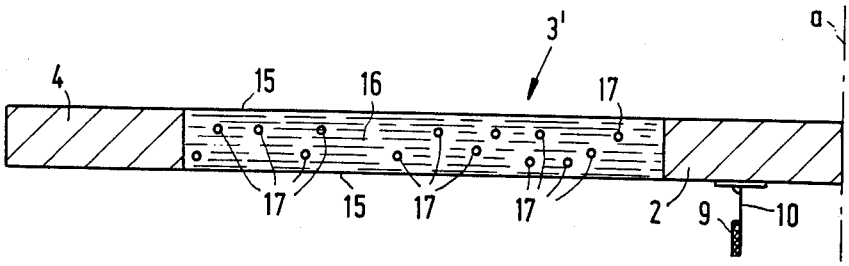
FIG. 6 shows a part of the transducer of FIG. 1, with a modified peripheral part.

FIG. 6 shows a part of another embodiment, in which the damping of the peripheral part is obtained in a different way. Here the peripheral part 3' comprises a laminate of two foils 15, for example two Kapton foils, between which a damping material 16, for example in the form of a class 2 ball bearing grease, is interposed. Should the mass $m_2$ of the peripheral part 3 be such that formula (4) cannot be satisfied, it is possible to mix the ball-bearing grease 16 with heavier or lighter particles 17. Examples are copper particles and hollow glass spheres or foam-plastics granules.

Figure 7:
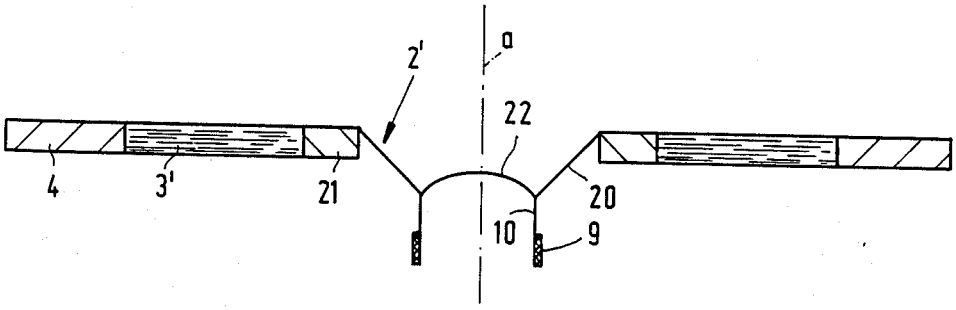
FIG. 7 shows a diaphragm in another embodiment of the invention.
Figure 8:
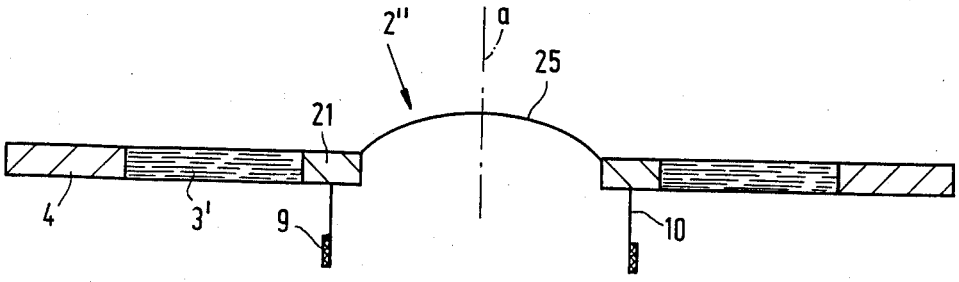
FIG. 8 shows yet another diaphragm.

FIGS. 7 and 8 show embodiments in which the central part is constructed in a different manner. FIG. 7 shows a central part 2' in the form of a cone and a portion 21. The cone 20 connects the voice-coil device 9, 10 to the portion 21, whose outer circumference is identical in shape to the outer circumference of the central part 2'. The voice-coil former 10 is sealed by means of a dust cap 22. The mass of the central part of the embodiment shown in FIG. 7 can be lower than that in the embodiment shown in FIG. 1. The same applies to the embodiment shown in FIG. 8, where the central part 2'' comprises the dome-shaped portion 25 and the portion 21.

It is to be noted that in the embodiments shown in FIGS. 7 and 8 the surface area $S_1$ of the central part 2' and 2'' respectively corresponds to the projection of the surface area of the central part onto a plane surface perpendicular to the axis a.

Figure 9:
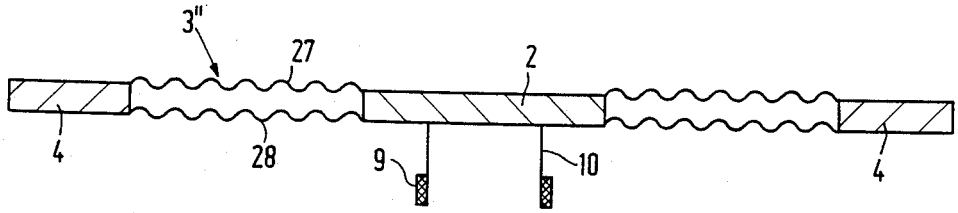
FIG. 9 shows still another diaphragm.

FIG. 9 shows an embodiment in which the peripheral part is different. FIG. 9 shows a peripheral part 3'' of a compliant flexible material which is formed with corrugations which extend over the surface of the peripheral part more or less parallel to the inner and outer circumference of the peripheral part 3'. The peripheral part may be formed in one piece. Alternatively it is possible, as is shown in FIG. 9, that the peripheral part comprises two corrugated layers 27 and 28 between which a damping material may be sandwiched, for example the aforementioned ball bearing grease. If the peripheral part is made of one piece (i.e. one layer) it is possible to provide a damping material, for example a polyurethane paste, between the corrugations on the peripheral part (not shown). Preferably, a reasonably large number of corrugations are provided. In transducers having the aforementioned dimensions five or more corrugations are preferred.

It is to be noted that various modifications of the embodiments shown are possible without departing from the scope of the invention as defined in the appended claims.

What is claimed is:

1. An electrodynamic transducer comprising, a diaphragm, a magnet system, and a voice-coil device situated in an air gap formed by the magnet system, the diaphragm comprising a central part and a surrounding peripheral part, the surface area of the peripheral part being larger than that of the central part, the central part having a higher stiffness than the peripheral part and the voice-coil device being coupled to the diaphragm central part, characterized in that the peripheral part has substantially no resistance to bending along a direction perpendicular to its inner circumference and in that the diaphragm cooperates with an at least substantially enclosed volume, the enclosed volume being selected in such a way that $$\frac{f_o}{f_o'} > 0.75\,\frac{S_2}{S_1},$$

where $S_1$ and $S_2$ are the surface areas of the central part and the peripheral part respectively, $f_o$ is the transducer anti-resonance frequency defined as that frequency in the frequency characteristic of the input impedance of the transducer which corresponds to a local minimum situated between two maxima in said characteristic which correspond to those two resonance frequencies for which the central part and the peripheral part of the diaphragm vibrate in phase and in phase opposition with one another, and $f_o'$ is an anti-resonance frequency for an otherwise similar transducer but without the enclosed volume and incorporated in a baffle, and further that $S_2/S_1 \geqq 2$.

2. An electrodynamic transducer as claimed in claim 1, characterized in that the peripheral part of the diaphragm is mechanically pretensioned.

3. An electrodynamic transducer as claimed in claim 1, characterized in that the peripheral part of the diaphragm includes corrugations which extend substantially parallel to the inner and outer circumference of the peripheral part.

4. An electro-dynamic transducer as claimed in claim 2 characterized in that $S_2/S_1$ complies with the following relationship: $2.5 \leqq S_2/S_1 \leqq 15$.

5. An electrodynamic transducer as claimed in claim 1, wherein the ratio $m_2/m_1$ is selected so as to satisfy $$\frac{\left[\frac{S_2}{S_1}\cdot\frac{f_o}{f_{o'}}\right]^2}{\left[\frac{f_o}{f_{o'}}\right]^2+\frac{1}{2}\left[\frac{S_2}{S_1}\right]^2-1} \leqq \frac{m_2}{m_1} \leqq \frac{\left[2\cdot\frac{S_2}{S_1}\cdot\frac{f_o}{f_{o'}}\right]^2}{\left[\frac{f_o}{f_{o'}}\right]^2+\frac{1}{2}\left[\frac{S_2}{S_1}\right]^2-1}$$

where $m_1$ is the mass of the central part and of the voice-coil device and $m_2$ is the mass of the peripheral part.

6. An electrodynamic transducer as claimed in claim 1, wherein the mechanical damping of the peripheral part is selected in such a way that the frequency characteristic of the input impedance of the transducer exhibits substantially two maxima only, which correspond to the two resonance frequencies for which the central part and the peripheral part of the diaphragm vibrate in phase and in phase-opposition relative to one another.

7. An electrodynamic transducer as claimed in claim 6, wherein the peripheral part includes a layer of a damping material.

8. An electrodynamic transducer as claimed in claim 7, wherein the peripheral part of the diaphragm comprises two layers with said layer of damping material therebetween, and the damping material comprises a class-2 ball-bearing grease deposited between the two layers of the peripheral part.

9. An electrodynamic transducer as claimed in claim 8, characterized in that the ball-bearing grease is mixed with a material of a higher density than that of the ball-bearing grease.

10. An electrodynamic transducer as claimed in claim 8, wherein the ball-bearing grease is mixed with a material of a lower density than that of the ball-bearing grease.

11. An electrodynamic transducer as claimed in claim 1, wherein the voice-coil device is coupled to the central part via an auxiliary cone.

12. An electrodynamic transducer as claimed in claim 1 wherein a portion of the central part of the diaphragm is situated within the voice coil device and is dome-shaped.

13. An electrodynamic transducer as claimed in claim 1, wherein $S_2/S_1$ complies with the following relationship: $2.5 \leqq S_2/S_1 \leqq 15$.

14. An electrodynamic transducer as claimed in claim 2, wherein the mechanical damping of the peripheral part is selected so that the frequency characteristic of the input impedance of the transducer exhibits substantially two maxima only, which correspond to the two resonance frequencies for which the central part and the peripheral part vibrate in phase and in phase opposition relative to one another.

15. An electrodynamic transducer as claimed in claim 4, wherein the mechanical damping of the peripheral part is selected so that the frequency characteristic of the input impedance of the transducer exhibits substantially two maxima only, which correspond to the two resonance frequencies for which the central part and the peripheral part vibrate in phase and in phase opposition relative to one another.

16. An electrodynamic transducer as claimed in claim 4, wherein the voice-coil device is coupled to the central part via an auxiliary cone.

17. An electrodynamic transducer as claimed in claim 1 wherein a portion of the central part of the diaphragm is situated directly above the voice coil device and is domed-shaped.

18. An electrodynamic transducer comprising: a magnet system with an air gap therein, a voice-coil device movably mounted in the air gap, a diaphragm comprising a central part coupled to the voice-coil device and a surrounding peripheral part, the peripheral part having a greater surface area ($S_2$) than that of the central part ($S_1$) and the central part having a greater stiffness than the peripheral part, wherein the peripheral part has substantially no resistance to bending in a direction perpendicular to its inner circumference, and means including a part of the magnet system for forming an enclosed volume behind the diaphragm that provides the following frequency relationship $$\frac{f_0}{f_{0'}} > 0.75\,\frac{S_2}{S_1}$$

where $f_o$ is the anti-resonance frequency of the transducer provided with the enclosed volume and $f_o'$ is the defined anti-resonance frequency of an otherwise identical transducer, but one which does not include the enclosed volume but does include a baffle, and wherein the ratio $S_2/S_1$ satisfies the following relationship $2.5 \leqq S_2/S_1 \leqq 15$.

19. An electrodynamic transducer as claimed in claim 18 wherein the peripheral part of the diaphragm is mechanically pretensioned in the plane of the diaphragm.

* * * * *